US005435226A

United States Patent [19]

McQuilkin

[11] Patent Number: 5,435,226

[45] Date of Patent: Jul. 25, 1995

[54] LIGHT ARMOR IMPROVEMENT

[75] Inventor: Frederick T. McQuilkin, Long Beach, Calif.

[73] Assignee: Rockwell International Corp., Seal Beach, Calif.

[21] Appl. No.: 100,396

[22] Filed: Nov. 22, 1993

[51] Int. Cl.[6] ..... F41H 5/04

[52] U.S. Cl. ..... 89/36.02; 428/117; 428/911

[58] Field of Search ..... 89/36.02; 428/117, 593, 428/911

[56] References Cited

U.S. PATENT DOCUMENTS

| | | | |
|---|---|---|---|
| 3,969,563 | 7/1976 | Hollis, Sr. | 89/36.02 |
| 4,499,156 | 2/1985 | Smith et al. | 428/614 |
| 5,235,895 | 8/1993 | Vanark et al. | 89/36.02 |

FOREIGN PATENT DOCUMENTS

| | | | |
|---|---|---|---|
| 2573511 | 5/1986 | France | 428/117 |
| 116685 | 11/1918 | United Kingdom | 89/36.02 |
| 7632 | 5/1991 | WIPO | 89/36.02 |

*Primary Examiner*—Stephen C. Bentley

*Attorney, Agent, or Firm*—Terrell P. Lewis; Charles T. Silberberg

[57] ABSTRACT

A structural armor assembly including a superplastically formed sandwich member having on one side one face sheet of high toughness, high-strength titanium alloy material, and on the other side a second face sheet made of non-superplastically formable metal matrix composite abrasive material. Abrasive materials in the form of "KEVLAR" ® or "SPECTRA" ® are provided inside cells in the sandwich member to serve as a "catcher's mitt" to absorb part or all of the energy of the ballistic fragments after they have been abraded by the material of the second face sheet.

22 Claims, 1 Drawing Sheet

LIGHT ARMOR IMPROVEMENT

BACKGROUND OF THE INVENTION

1. Field of the Invention

The present invention relates to armor structures, and more particularly to light-weight, high strength structural armor components having improved capability for impeding penetration therethrough by high-speed projectiles.

2. Background of the Invention

Conventional armor plating is typically made of ceramic materials, metallic materials, high-elongation organic materials, or a combination two or more thereof. An example of conventional armor, shown in U.S. Pat. No. 4,404,889 to Miguel, includes layers of high density steel honeycomb, balsa wood, and ballistic resistant nylon sandwiched in various arrangements between outer layers of steel armor plate.

Ceramic materials offer significant efficiency in defeating armor piercing projectiles at the lowest weight per square foot of surface area. The ceramic armor sections are generally mounted on a tough support layer such as glass-reinforced plastics. Boron carbide, silicon carbide and alumina are ceramics which are commonly used in armor plating.

However, ceramic plates have the serious drawback of being unable to sustain and defeat multiple hits by armor piercing projectiles. Because relatively large sections of ceramic material must be used to stop these projectiles and because these sections shatter completely when hit by a projectile, the ceramic armor is unable to defeat a second projectile impacting close to the preceding impact. Moreover, sympathic shattering of adjacent ceramic sections usually occurs, still further increasing the danger of penetration by multiple rounds.

In addition, ceramic armors are difficult and costly to manufacture; not only are very high manufacturing temperatures required, but also processing is time consuming because very slow cooling is necessary to avoid cracking.

Metallic materials have been implemented for light weight armor applications because they possess excellent ability to defeat multiple, closely spaced impacts of armor piercing projectiles. However, this class of materials is often far heavier than desired and difficult to fabricate into intricate contours. Moreover, the weight of metallic materials has typically precluded its extensive use in such light-weight mobile weapons systems as helicopters and small water craft.

While neither of these materials systems, by itself, can achieve the results of the other, heretofore their implementation in combination has also failed to achieve the totality of desired results.

OBJECTS OF THE INVENTION

It is therefore a principal object of the present invention to provide a new and improved light-weight armor structure which will combine all the properties and advantages of ceramic and metallic material systems, while also overcoming all the disadvantages and drawbacks of known similar structures.

Another object of the invention is to provide a structural armor member including a truss core and face sheet element made via superplastic forming and diffusion bonding techniques from high-strength titanium alloy material, and a second face sheet made from a metal matrix composite abrasive material and thereafter bonded to the truss core.

Still another object is to provide a structural armor component useful in protecting floor and wall panels of aircraft where the component includes one face sheet of high toughness Corona 5 titanium alloy diffusion bonded to a superplastically formed truss core sandwich and non-superplastically formable abrasive materials carried by the truss core.

These and other objects are accomplished by providing a superplastically formed sandwich member having on one side one face sheet of high toughness Corona 5 titanium alloy and on the opposite side a second face sheet made of non-superplastically formable metal matrix composite abrasive material, such as Corona 5 titanium and silicon carbide.

Abrasive materials or laminated materials comprising high strength synthetic fibers, as for example the laminated materials known as "KEVLAR" ® and "SPECTRA" ® may be provided in the interior cells of the sandwich member to serve as a "catcher's mitt" to absorb part or all of tile energy of the ballistic fragments after they have been abraded by the Corona 5 and silicon carbide layer,

BRIEF DESCRIPTION OF THE DRAWING

FIGS. *2a–2c* are sectional views of the first embodiment of structural armor component depicting a sequence of steps in which abrasive or energy-absorbing laminate materials are bonded within the interior cells of the truss core element.

DETAILED DESCRIPTION OF THE INVENTION

Figure 1:
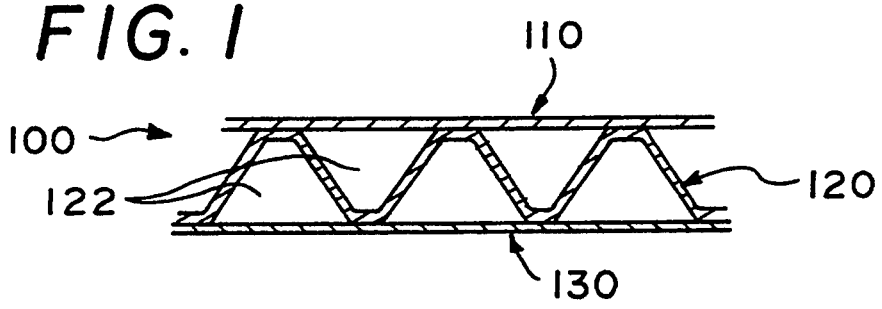
FIG. 1 is a sectional view of a first embodiment of the structural armor component made in accordance with the present invention.

Referring now to FIG. 1, there is shown a first embodiment 100 of the structural armor member contemplated by the present invention. As shown, the embodiment comprises a core subassembly including two face sheets 110 and 130, and a truss core element 120 having multiple interior cells 122.

The subassembly is fabricated using diffusion bonding and superplastic forming techniques which are well-known in the prior art.

Face sheets 110 and 130 and the truss core element 120 each comprise a high toughness, high strength titanium alloy, known as Corona 5 titanium, having the composition of 4.5 wt. % Al, 5 wt. % Mo, and 1.5 wt. % Cr, with the remainder being titantium.

Face sheets 100 and 130 are highly efficient in their resistance to puncture by projectiles. This characteristic results from the use of the alloy materials identified above.

Penetration of the core element 120 by a projectile, if it has punctured the face sheet 110, is deterred through the filling of the channels or cells in the truss core element with abrasive laminate materials designed to erode and cause disintegration of the projectile as it travels through this material, or with energy-absorbing laminated materials comprising high strength synthetic fibers, as for example the energy-absorbing laminated materials known as "KEVLAR" ® (a fabric with a two-dimensional weave) or "SPECTRA"® (a fabric with a three-dimensional weave).

Figure 2A:
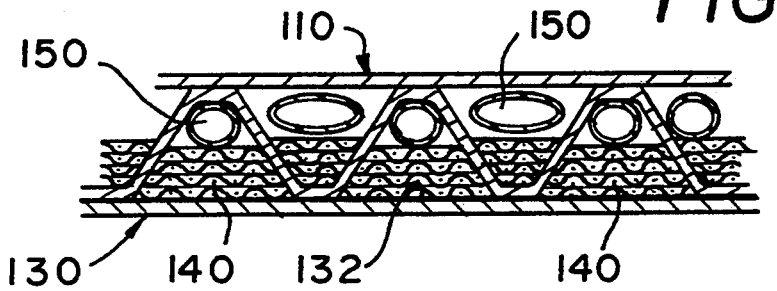

Installation of the laminate materials in the cells of the truss core element of the structural armor component of FIG. 1 is accomplished in the following manner (refer to FIGS. 2a–2c):

(1) As shown in FIG. 2a, woven cloths or laminates 140 of the material are disposed adjacent the lower face sheet 130 and laid atop a layer of adhesive 132 which has been applied to the inside surface of the lower face sheet. An inflatable bladder 150 is then positioned within each cell 122 atop the laminate in that cell to fill the space remaining between the laminate and the upper face sheet 110.

Figure 2B:
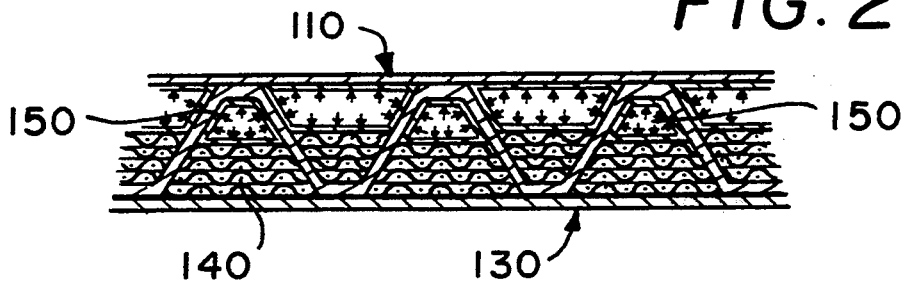

(2) With reference to FIG. 2b, each of the bladders 150 is inflated whereby the space remaining within the cells is filled. The inflated bladder exerts great pressure against the laminate in that cell and holds it in place against the lower face sheet 130 for a given period of time during which bonding of the laminate to the lower face sheet takes place.

Figure 2C:
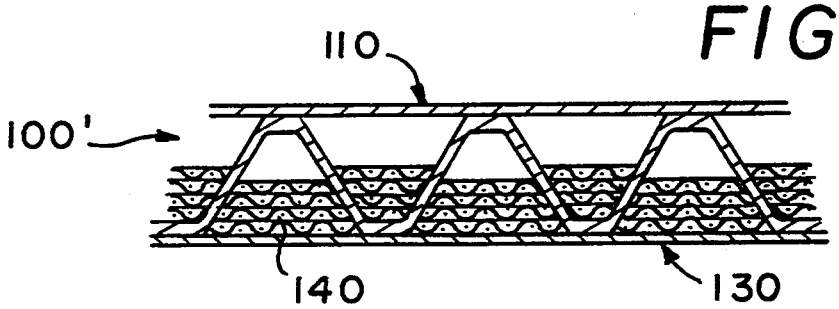

(3) FIG. 2c shows the laminate-augmented armor component 100' which is obtained from the foregoing process, after the bladders have been deflated and removed.

Figure 3:
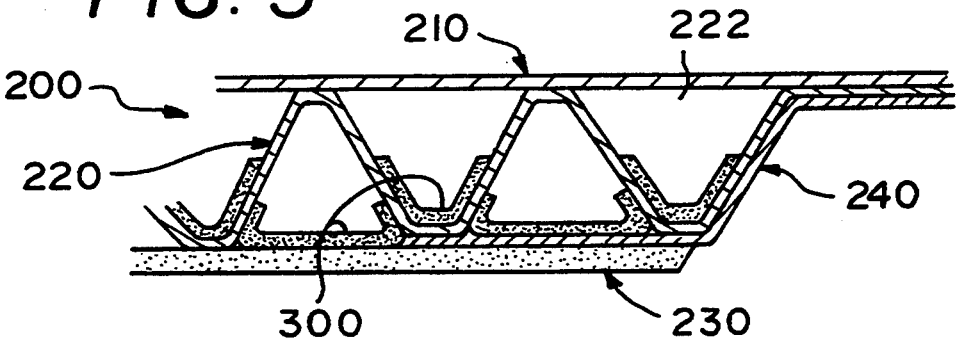
FIG. 3 shows a second embodiment of the structural armor component made in accordance with the present invention.

FIG. 3 shows a second embodiment 200 of the structural armor member contemplated by the present invention, which comprises a first face sheet 210, a truss core element 220 having multiple interior cells 222, and a second face sheet 230. An edge close-out element 240 may also be included, as discussed below in more detail.

The assembly is fabricated using diffusion bonding and superplastic forming techniques which are well-known in the prior art. The second face sheet 230 is a non-super-plastically formable metal matrix composite material comprising Corona 5 titanium alloy.

The second face sheet 230 is may be secured to the truss core element during or following the superplastic forming and diffusion bonding process used for formation of the structural armor component 200. One method for joining the second face sheet 230 with the truss core element is via diffusion bonding.

Alternatively, during fabrication of the structural armor component 200, a partial face sheet and edge close-out element 240 may be secured to the side of the truss core opposite the first face sheet 210. The close-out element, made of Corona 5 titanium alloy and bonded to the truss core where contact between the two is made, acts to reinforce the edge region of the truss core element 200 where the structural armor component is to be secured to chassis or frame structure of the vehicle.

As with the first embodiment 100 of structural armor described above, the first face sheet 210 and the truss core element 220 each comprise a high toughness, high strength titanium alloy, known as Corona 5 titanium, having the composition of 4.5 wt. % Al, 5 wt. % Mo, and 1.5 wt. % Cr, with the remainder being Ti. Moreover, face sheets 210 and 230 are highly efficient in their resistance to puncture by projectiles, and exhibit the same characteristics as those described above in connection with the first embodiment 100 of the structural armor component.

The materials contemplated for use with the second embodiment 200 of structural armor are the same fabrics or laminated materials as were described in connection with the first embodiment 300 known as "KEVLAR"® (a fabric with a two-dimensional weave) and "SPECTRA"® (a fabric with a three-dimensional weave). The laminates may be bonded in place along the inner surface of the second face sheet 230 following the superplastic forming and diffusion bonding process associated with formation of the core subassembly.

While certain representative embodiments and details have been shown for the purpose of illustrating the invention, it will be apparent to those skilled in this art that various changes and modifications may be made therein without departing from the spirit or scope of this invention.

What is claimed is:

1. A structural armor component, comprising:

first and second sheets secured on opposite sides of a truss core member, said truss core member and one of said face sheets comprising a high toughness, high strength titanium alloy, and said second face sheet comprising a non-superplastic formable metal matrix composite material, and woven abrasive materials disposed within interior cells of said truss core member for eroding and disintegrating a projectile which has entered the interior of said truss core member, both said first and second face sheets being diffusion bonded to said truss core member.

2. The structural armor component of claim 1, wherein said second face sheet comprises an abrasive material for significantly diminishing the speed of a projectile which has impacted and penetrated the second face sheet.

3. The structural armor component of claim 1, wherein said woven abrasive materials are adhesively secured within said interior cells of said truss core.

4. The structural armor component of claim 1, and further including energy absorbing materials secured within interior cells of said truss core.

5. The structural armor component of claim 1, wherein at least said one face sheet member comprises an alloy having the composition of 4.5 wt. % Al, 5 wt. % Mo, and 1.5 wt. % Cr, with the remainder being titanium.

6. The structural armor component of claim 5, wherein said truss core member also has said composition.

7. A structural armor assembly, comprising:

a first puncture-resistant sheet, a second puncture-resistant sheet in facing relationship to said first sheet, a cellular element disposed between said first and second sheets, and means, disposed in cells in said cellular element, for deterring passage of a projectile, which has penetrated one sheet, through said cellular element, said deterring means comprising abrasive laminate materials for eroding and disintegrating said projectile.

8. The structural armor assembly of claim 7, wherein at least said first sheet comprises Corona 5 titanium.

9. The structural armor assembly of claim 7, wherein said abrasive laminate materials for eroding and disintegrating the projectile are secured to selected surfaces of the cells in said cellular element.

10. The structural armor member of claim 9, wherein said abrasive laminate materials are adhesively secured to said surfaces of said cells.

11. The structural armor assembly of claim 7, wherein said deterring means comprises energy-absorbing materials.

12. The structural armor assembly of claim 11, wherein said energy-absorbing materials comprise "KEVLAR" ®.

13. The structural armor assembly of claim 11, wherein said energy-absorbing materials comprise "SPECTRA" ®.

14. A structural armor member, comprising:

a superplastically formed core member, projectile-abrading means bonded to said core member and forming a sandwich therewith, and woven energy-absorbing materials secured within cells within said core member for absorbing energy of projectile fragments after they have been abraded by said projectile-abrading means.

15. The structural armor member of claim 14, wherein said projectile-abrading means comprises a face sheet, and said energy-absorbing materials are secured adhesive within cells in said core member.

16. The structural armor member of claim 15, wherein said core member and said face sheet are formed of titanium alloy materials and are diffusion bonded together.

17. The structural armor member of claim 15, wherein said face sheet comprises non-superplastically formable metal matrix composite abrasive material.

18. The structural member of claim 17, wherein said energy-absorbing materials comprise woven laminate material.

19. The structural member of claim 18, wherein said energy-absorbing materials comprise "KEVLAR" ®.

20. The structural member of claim 18, wherein said energy-absorbing materials comprise "SPECTRA" ®.

21. The structural armor member of claim 15, and further including adhesive means for bonding said energy absorbing materials to selected surfaces of said cells.

22. The structural armor member of claim 14, wherein said projectile-abrading means comprises a face sheet of Corona 5 titanium alloy material.

* * * * *